US006957988B2

(12) United States Patent
Kieninger et al.

(10) Patent No.: US 6,957,988 B2
(45) Date of Patent: Oct. 25, 2005

(54) CLIP UNIT FOR HOLDING CONTACT

(75) Inventors: Hans Kieninger, Stuttgart (DE); Andreas Wolfgang Wyderka, Korb (DE); Matthias Jürgen Raithel, Waiblingen (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 95 days.

(21) Appl. No.: 10/639,182

(22) Filed: Aug. 12, 2003

(65) Prior Publication Data

US 2004/0033104 A1 Feb. 19, 2004

(30) Foreign Application Priority Data

Aug. 16, 2002 (DE) ..... 102 37 666

(51) Int. Cl.[7] ..... H01R 13/428
(52) U.S. Cl. ..... 439/744; 439/871
(58) Field of Search ..... 439/744–745, 439/871

(56) References Cited

U.S. PATENT DOCUMENTS 2,389,455 A * 11/1945 Benander ..... 439/740
3,068,443 A * 12/1962 Nava et al. ..... 439/587
3,143,385 A * 8/1964 Zimmerman, Jr. et al. . 439/744
4,262,987 A * 4/1981 Gallusser et al. ..... 439/843
4,269,472 A * 5/1981 Shaffer et al. ..... 439/846
4,701,004 A * 10/1987 Yohn ..... 439/871
4,776,816 A * 10/1988 Herscovici et al. ..... 439/744
4,988,316 A * 1/1991 Roy ..... 439/744
5,108,318 A * 4/1992 Sakurai et al. ..... 439/744
5,118,303 A * 6/1992 LeBaron et al. ..... 439/286
5,389,013 A * 2/1995 Kourimsky ..... 439/746
5,934,945 A * 8/1999 Petersen et al. ..... 439/744

FOREIGN PATENT DOCUMENTS

DE 29907495 U1 9/1999

* cited by examiner

*Primary Examiner*—Truc Nguyen
(74) *Attorney, Agent, or Firm*—Peter Van Winkle

(57) ABSTRACT

A clip unit (10) that holds an electrical contact (11) in a passageway (12) of a connector frame (13), is of small cost and small length and can be installed using a small force, and provides the functions of centering a location along the contact within the passageway and preventing rearward movement of the contact along the passageway. The unit includes front and rear ring-shaped clip elements (25, 35) that each has a slot (26, 36) that is expanded to mount the unit in a neck (18) of the contact. A contact with the unit installed is pushed forwardly along the passageway until the front clip element encounters a constriction (45) in the passageway which compresses the diameter of the front clip element until it moves forward of the constriction and then expands. Thereafter, a rear end (27) of the front element abuts the constriction while a front end of the front element abuts a collar (17) of the contact to prevent rearward movement of the contact. After installation, the rear element lies within the frame constriction and centers the neck within the constriction.

11 Claims, 5 Drawing Sheets

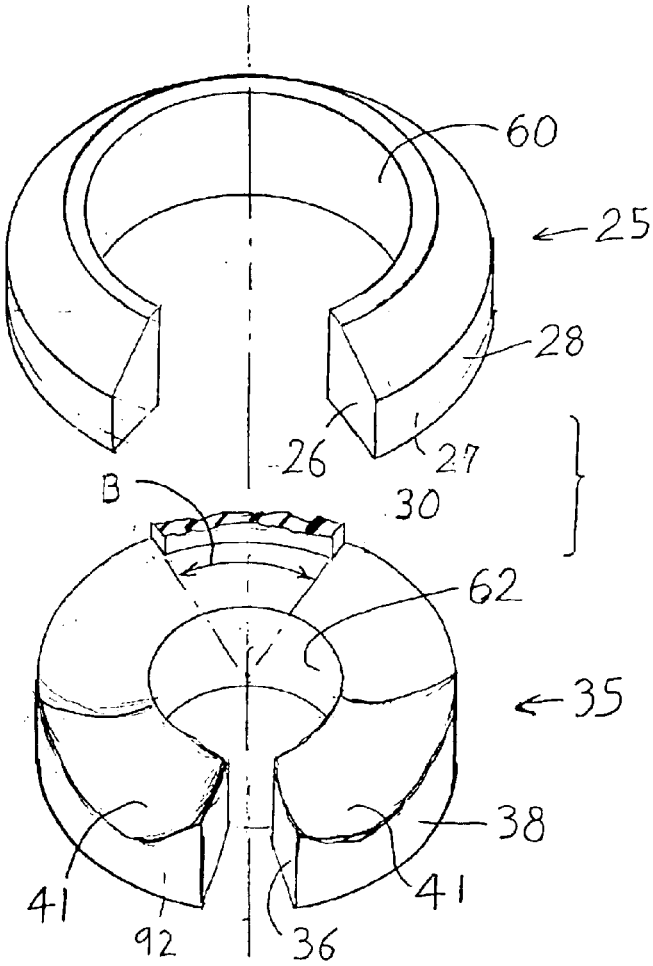
FIG. 5
FIG. 6
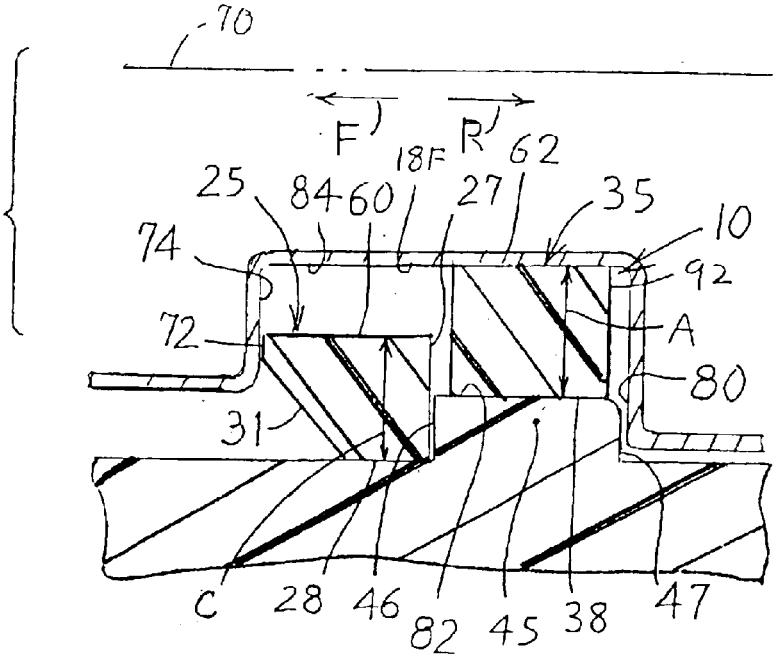

CLIP UNIT FOR HOLDING CONTACT

CROSS-REFERENCE

Applicant claims priority from German patent application No. 10237666.2-34 filed Aug. 18, 2002.

BACKGROUND OF THE INVENTION

A variety of clips are used to mount electrical contacts within passages of connector frames. A clip that could be easily mounted on a contact and which could be installed in a passageway using low force, would be of value. German patent DE29907495 shows a metallic clip unit that positions a contact in an axial direction, but does not also position a location along the clip in a radial direction. A simple and easily installed clip that positioned a contact to center the contact in a passage as well as to radially locate the contact, would be of value.

SUMMARY OF THE INVENTION

In accordance with one embodiment of the present invention, a clip unit is provided for holding a contact within a passage of a frame, wherein the clip unit can be readily mounted on the contact and allows the contact to be inserted into the passage with minimal force, while holding the contact against both axial and radial movement. The clip unit has front and rear ring-shaped elements that each has a hole lying along an axis of the unit and that each has an outside surface. The contact is provided with a neck onto which the clip unit is installed, and the passageway is provided with a constriction. With the clip unit mounted on the neck of the contact, the combination of contact and clip unit is inserted forwardly into the passageway. When the front element of the clip unit encounters the constriction, the front element is compressed in diameter until it passes forwardly through the constriction and lies immediately forward of the constriction. Then, a front surface of the front element abuts a collar formed on the contact immediately forward of the neck while a rear surface of the front element abuts a front end of the constriction, to thereby prevent the contact from moving rearwardly along the passage. During installation, the rear element passes into and remains within the constriction. The rear element closely fits in the space between the neck and constriction, to closely center the contact within the constriction.

The front and rear elements of the clip unit are joined by a ridge, to allow each unit to be independently compressed and expanded. The unit is preferably integrally molded of plastic.

The novel features of the invention are set forth with particularity in the appended claims. The invention will be best understood from the following description when read in conjunction with the accompanying drawings.

BRIEF DESCRIPTION OF THE DRAWINGS

FIG. 5 is an exploded isometric view of the clip unit of FIG. 1.

FIG. 6 is a partial sectional view of the clip unit, contact, and frame of FIG. 3.

DESCRIPTION OF THE PREFERRED EMBODIMENTS

Figure 1:
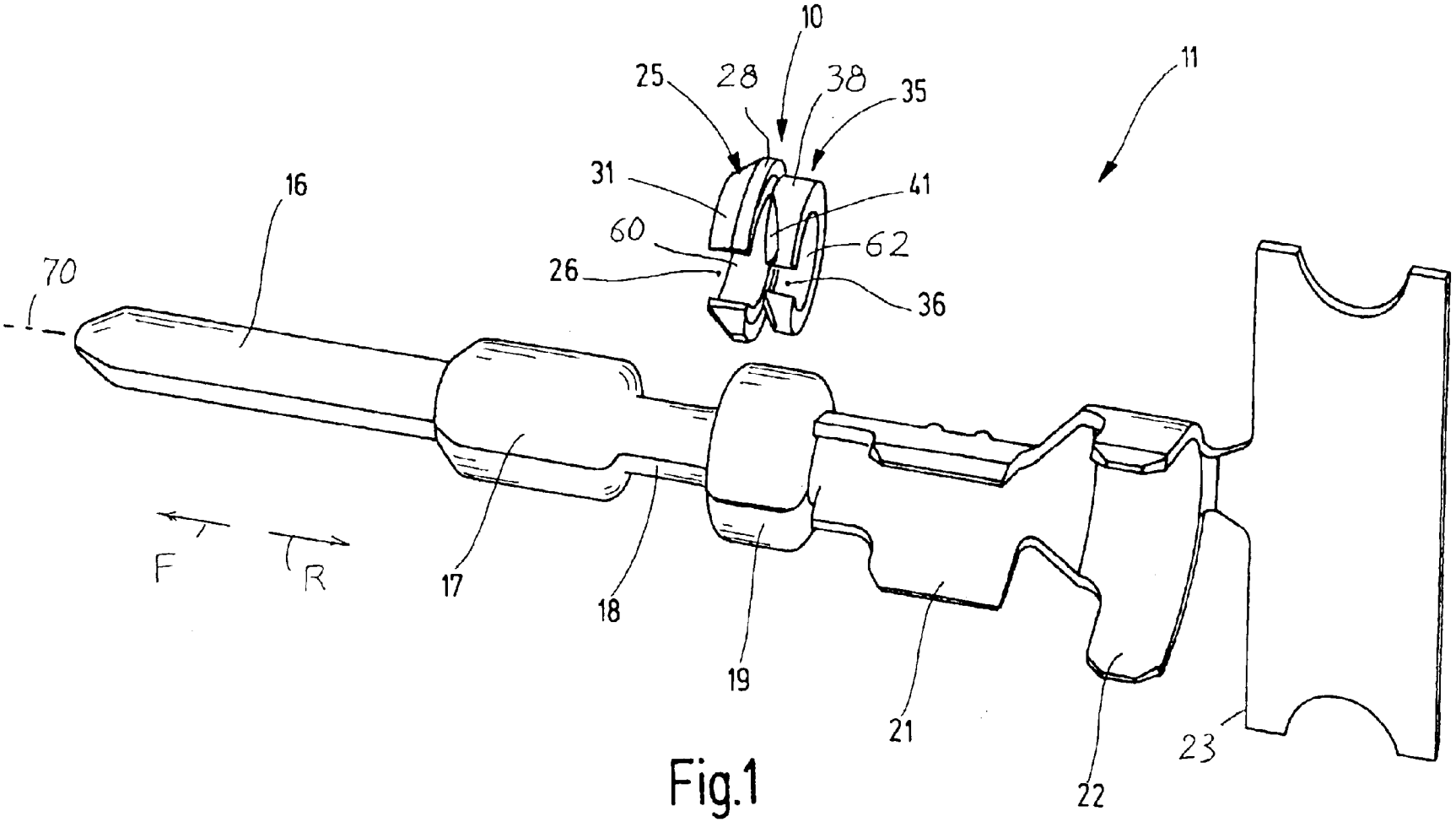
FIG. 1 is an exploded isometric view showing a contact and a clip unit of the present invention, the contact being shown mounted on a carrier strip prior to being severed therefrom.

FIG. 1 illustrates a contact 11 of the present invention, that is formed of sheet metal and that has a front F mating end 16 in the form of a pin for mating with a socket of another connector. The contact has a rear R end forming a pair of crimp regions 21, 22 and has a rear end connected to a carrier strip 23 on which a plurality of contacts have been formed. The crimp region 21 is crimped around a bared wire while the crimp region 22 is crimped around the wire insulation. The contact also has front and rear collars 17, 19, and forms a neck 18 of reduced diameter between the collars. A clip unit 10 for holding the contact in a passageway of a frame, includes clip front and rear elements 25, 35, and a ridge that connects them. Each of the clip elements is in the form of a ring with a hole 60, 62, and with a slot 26, 36 that connects an outside surface 28, 38 of the clip element to the walls of the hole. The contact 11 has an axis 70 and the holes of the clip elements have axes that are substantially concentric with the axis 70 when the clip unit is installed on the neck 18 of the contact.

Figure 2:
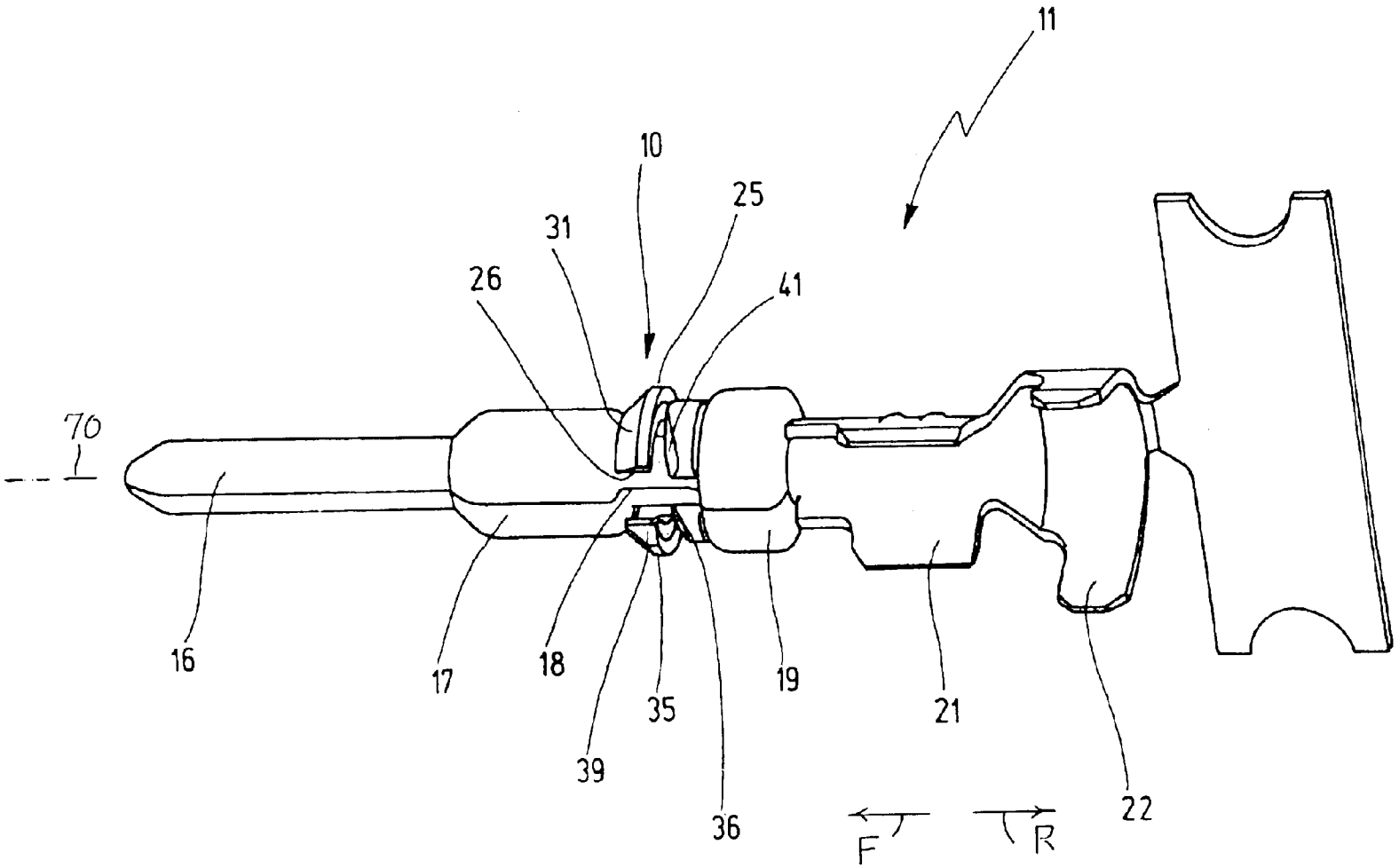
FIG. 2 is an isometric view similar to that of FIG. 1, but showing the clip unit mounted on the contact.

FIG. 2 shows the clip unit 10 installed on the neck 18 of the contact. This is accomplished by opening the slots 26, 36 until the clip elements fit around the neck. The slots partial close to their initial configurations, and are retained on the contact neck.

Figure 3:
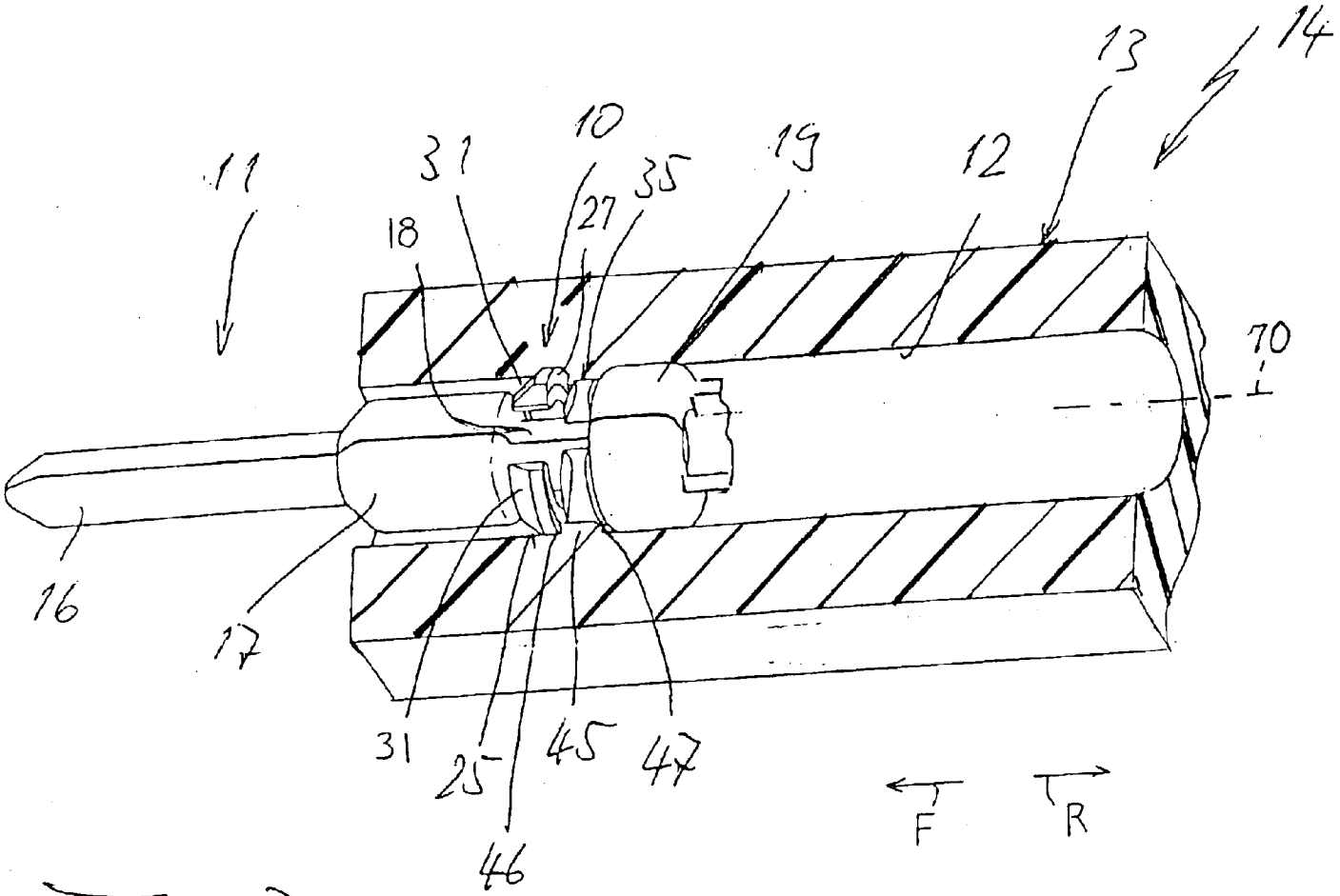
FIG. 3 is an isometric view showing a portion of the contact of FIG. 2 with the clip unit mounted thereon, and showing the combination lying in a passageway of a connector frame.

FIG. 3 shows the contact 11 with the clip unit 10 thereon, installed in a passageway 12 of an insulative frame 13 of a connector. The frame is preferably molded of plastic. The passageway 12 is of uniform cross-section, except at a constriction 45 in the passage, where the diameter is suddenly reduced. The constriction preferably extends 360° around the axis 70 of the passage and of the contact, although it is possible to provide interruptions. As shown in FIG. 6, the wall of the passageway constriction has front and rear constriction shoulders 46, 47. The front clip element 25 has a rear shoulder 27 that abuts the front shoulder 46 of the constriction, so that when the clip unit is fully installed, the clip front member 25 cannot move rearward. The front clip member has a forwardly-facing front shoulder 72 that lies adjacent to a rearwardly-facing neck front shoulder 74. The neck has a rear shoulder 80 that abuts the rear shoulder 47 of the constriction. The abutting shoulders result in the contact 11 being substantially fixed against axial movement along the axis 70. There is usually a very small gap less than 0.1 mm between the abutting shoulders, so the contact cannot noticeably rattle axially.

The rear clip member 35 serves to radially position the contact 11, that is, to fix the radial position of the contact at the location of the clip element 35, so that location of the contact lies accurately on the axis 70 and cannot obviously rattle radially. This is accomplished by forming the rear clip element 35 so it has a radial thickness A substantially equal to the radial distance between the inside surface 82 of the constriction and the outside surface 84 of the neck.

To install the contact 11 shown in FIG. 2 into the passageway, the contact with the clip unit 10 installed thereon, is merely pushed forwardly into the passage shown at 12 in FIG. 3. Initially, a chamfered, or tapered front surface 31 of the clip front element engages the rear shoulder 47 of the constriction. A radially inner corner of the constriction is bevelled, as by being rounded, to help compress the front clip element 25 in diameter so it can move axially across the constriction, until the front clip element lies forward of the constriction and in a front portion 18F of the neck as shown in FIG. 6. During such forward movement of the clip unit, the clip rear element 35 is normally not compressed in diameter, but fits closely between the contact neck 18 and the constriction 45. It is noted that the axial length of the constriction 45 is slightly greater than the axial length of the clip rear element 35.

Figure 4A:
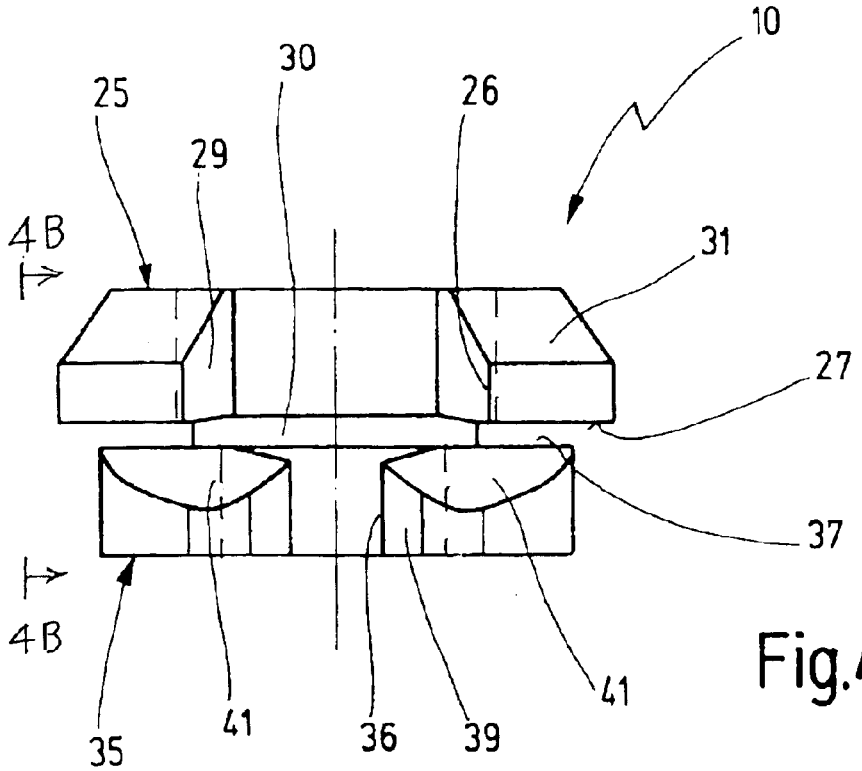
FIG. 4A is a side elevation view of the clip unit of FIG. 1.
Figure 4B:
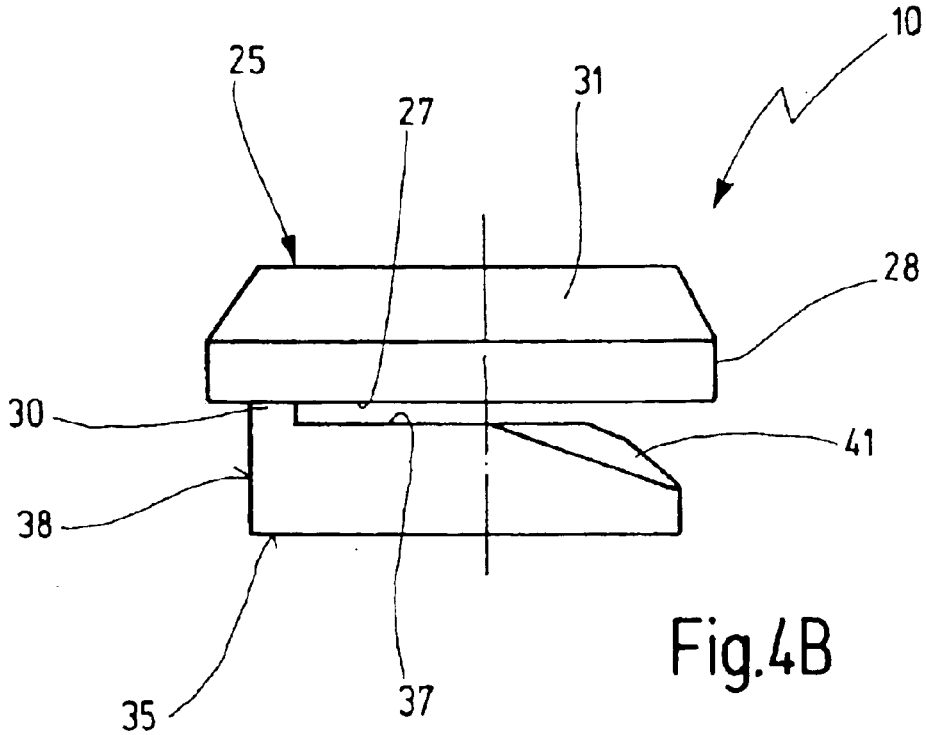
FIG. 4B is an elevation view taken on line 4B—4B of FIG. 4A.

FIGS. 4A, 4B and 5 show that the clip unit 10 includes a ridge 30 that connects the clip front and rear elements 25, 35. The slots 26, 36 in the clip elements have at least portions aligned so they both lie at one side of the unit, and the ridge 30 lies on an opposite side of the unit. The ridge has an outside, or circumferential surface that is preferably flush with the outer surface of the rear element. This avoids an extra step that resists installation (and removal) of the clip from the passageway. The ridge extends by an angle B that is preferably no more than about 90° and more preferably no more than 60°, since a larger angle would resist bending of the unit at the ridge. The ability of the unit to bend slightly at the ridge is desirable in helping the front clip element deflect around the constriction.

The outer surface 28 of the front clip element is of larger diameter than the outer surface 38 of the rear clip element in the initial (undeflected) configuration of the clip unit. The larger diameter of the clip front element is required so its rear shoulder 27 can press against the constriction shoulder 46 (FIG. 6). The outer surface of the rear element can be smaller because the rear element does not have to expand to a diameter greater than the inside diameter of the passageway constriction. Similarly, the hole 60 (FIG. 5) in the clip front element is of larger diameter than the hole 62 in the clip rear element, in the initial configuration of the clip unit as is the slot 26. The larger hole 60 and slot 26 are provided because when the front clip unit 25 (FIG. 6) passes across the constriction 45 (FIG. 6), the clip front element must be compressed to fit through the constriction. When the front clip element passes forward of the constriction 45, both the inside diameter (at hole 60) and outside diameter (at outside surface 28) must expand in diameter so that the outside surface diameter is greater than the inside diameter of the constriction. The radial thickness C of the front element is no more than the radial distance (approximately A) of the space that the front element must pass through.

FIG. 5 shows that the rear clip element 35 has chamfered, or tapered surfaces 41 on opposite sides of its slot 36. These chamfered surfaces help compression of the rear clip element if its initial diameter is greater than the inside diameter of the constriction. The chamfers do not extend all the way to the rear edge 92 of the clip rear element, so the slot 36 is narrow. A narrow slot 36 is desirable to provide accurate centering of the contact in the passage. A large slot 26 in the clip front element enables large compression, is acceptable because the front clip unit does not center the contact in the passageway.

The clip unit 10 is preferably formed by injection molding as a single integrally-molded unit. Although it would be possible to form the clip unit of metal, this is not desirable. A machined metal part has thick walls and, because of the high rigidity of engineering metals, would require a large force to install the clip unit. A sheet metal clip unit can have the same resilience as a plastic unit. However, because of the much greater thickness of a molded plastic unit of the same resilience as sheet metal, the molded plastic unit has greater rigidity against deflection, due to the fact that rigidity increases in proportion to the third power of the thickness of materials.

Thus, the invention provides a clip unit for mounting a contact (of pin or socket type) in a passageway of a frame, wherein the clip unit enables contact installation with only moderate force, and the clip unit not only axially fixes the position of a location along the contact, but also fixes the location radially. The clip unit is used with a contact that has a neck where the contact is of smaller outside diameter than at locations immediately forward or rearward of the neck, and is used with a frame passageway that has a constriction where the passageway is of smaller inside diameter than at locations immediately forward or rearward of the constriction. The clip has a rear clip element that is slightly less long in an axial direction than the constriction and that fits closely between the outside of the neck and the inside of the constriction to center the contact. The clip front element has a hole large enough to allow the front element to be compressed to pass forwardly through the restriction, but when released it expands to a greater diameter so a rear end of the front element abuts a front end of the constriction. The front and rear elements of the clip unit are preferably integrally molded, with a narrow ridge connecting them and not only allowing the elements to individually contract and expand in diameter but to allow slight tilt.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A clip unit for holding an electrical contact in a passageway of an insulative frame, wherein the contact has a neck with an outer neck wall and opposite neck ends, the passageway has an axis, and walls of the passageway form a passageway constriction with a radially inner constriction wall, wherein:

said clip unit includes front and rear elements that each has a hole lying on said axis and forms hole walls, said elements each has a largely cylindrical outside surface, and said elements each has a slot for receiving said neck of said contact during mounting of the elements around said neck;

said front element has a front shoulder for engaging a front end of said neck and a rear shoulder for engaging a front end of said constriction, and said rear element has a radial thickness that enables its largely cylindrical outside surface to lie closely adjacent to said constriction radially inner wall while said rear element hole wall lies closely adjacent to said outer neck wall, said front element having a radial thickness that allows said front element to be compressed to pass through said constriction while lying around said neck.

2. The unit described in claim 1 including said contact and said frame, with said contact lying in said frame, wherein:

said contact has front and rear collars lying respectively forward and rearward of said neck, said front collar having an outside diameter no greater than the inside diameter of said passageway constriction to pass through it, but said rear collar has a larger diameter than the inside diameter of said projection to be stopped by said projection.

3. The unit described in claim 2 wherein:

said frame is formed of molded plastic, said contact is formed of sheet metal, and said front and rear elements are formed of molded plastic having sufficient resilience to allow said elements to deflect around said neck, so said elements can receive said neck through the slots in said elements.

4. The unit described in claim 1 wherein:

said unit includes a ridge connecting said first and second elements and holding then spaced apart along said axis, said ridge extending no more than 90° about said axis to allow the ridge to bend, and said elements and ridge being integrally molded.

5. The unit described in claim 1 wherein:

in an initial, unreflected orientation of said unit, said hole of said front element has a larger inside diameter than the hole in said rear element, and said slot in said front element is larger than said slot in said rear element, to allow said front element to be compressed so its larger diameter outside surface can pass through said passage constriction.

6. The unit described in claim 1 wherein:

said front element outside surface has a front that is bevelled, to facilitate compression in diameter of said front element by pressing it forwardly past said passageway constriction.

7. The unit described in claim 6 wherein:

said front and rear elements are joined at sides opposite said slots, and said rear element has chamfered surface regions on opposite sides of its slot at a front end of the rear element.

8. A clip unit in combination with a frame that has a passageway with an axis and a contact that lies in said passageway, wherein:

said passageway has a constriction where the inside diameter of the passageway is reduced, the constriction having front and rear ends and the inside diameter of the passageway is greater forward and rearward of said constriction than at said constriction;

said contact has a neck of reduced outside diameter and said contact has front and rear collars lying respectively forward and rearward of the neck, said collars having larger outside diameters than the outside diameter at said neck, said neck lying within said constriction in said passageway;

said unit has front and rear ring-shaped elements that each has a hole lying on said axis and forming a hole inside surface, that each has an outside surface, and that each has a slot extending from said outside surface to the corresponding hole inside surface, said front and rear elements being isolated from each other so the slot of each can be individually compressed and expanded;

said front element is of larger outside diameter than said rear element, said front element has a front surface substantially abutting a rear end of said front collar, and said front element has a rear surface abutting a front end of said constriction, to prevent rearward movement of the contact;

said rear element has a radial thickness about equal to the radial space between said contact neck and said passageway constriction, to radially position said contact in said passageway.

9. The combination described in claim 8 wherein:

said neck has a front portion that lies forward of a front end of said constriction and said front element lies around said neck front portion;

said front element has a radial thickness (C), between its hole and its outside surface, which is no more than the radial distance between paid neck and said constriction.

10. The combination described in claim 8 including:

a ridge that is circumferentially spaced from said slots and that connects said front and rear elements, said elements and said ridge being integrally molded of a plastic material.

11. A method for establishing a clip unit that includes a front element that has a slot and a rear ring-shaped element that has a slot, between a contact that has a neck and walls of a passageway that has a constriction, comprising:

installing the front element in the contact neck by expanding the slot and pressing the element onto the contact neck;

installing the contact with the front element thereon in the passageway by pressing the contact forwardly along the passageway, including using a rear end of the constriction to compress the front element so it passes through the constriction, and allowing the front element to expand when it lies forward of the constriction and abut a front end of the contact neck and abut a front end of the constriction to prevent rearward movement of the contact;

installing said rear element in the contact neck behind the front element; and while said front element is passing through said constriction, moving said rear element into said constriction to radially position said contact.

* * * * *